US009530575B2

(12) United States Patent
Flegel et al.

(10) Patent No.: US 9,530,575 B2
(45) Date of Patent: Dec. 27, 2016

(54) TRANSFER SWITCH FOR SEQUENTIALLY DERIVED SYSTEM

(75) Inventors: Jeffrey D. Flegel, Racine, WI (US); Benjamin F. Flegel, Racine, WI (US)

(73) Assignee: Reliance Controls Corporation, Racine, WI (US)

( * ) Notice: Subject to any disclaimer, the term of this patent is extended or adjusted under 35 U.S.C. 154(b) by 333 days.

(21) Appl. No.: 13/539,781

(22) Filed: Jul. 2, 2012

(65) Prior Publication Data

US 2014/0001016 A1 Jan. 2, 2014

(51) Int. Cl.

| | |
|---|---|
| ***H01H 1/00*** | (2006.01) |
| ***H01H 9/00*** | (2006.01) |
| ***H01H 1/42*** | (2006.01) |
| ***H01H 21/58*** | (2006.01) |

(52) U.S. Cl.

CPC ..... *H01H 1/42* (2013.01); *H01H 21/58* (2013.01)

(58) Field of Classification Search

CPC ..... H01H 1/42; H01H 21/54; H01H 21/58; H01H 21/60

USPC ..... 200/271, 50.01, 50.32–50.35, 50.37,200/50.39, 50.4, 15

See application file for complete search history.

(56) References Cited

U.S. PATENT DOCUMENTS

| | | | | |
|---|---|---|---|---|
| 1,465,384 | A * | 8/1923 | Wescoat | 200/5 R |
| 1,853,642 | A * | 4/1932 | Simmons | 361/145 |
| 3,646,299 | A * | 2/1972 | Stene | H01H 1/502 200/255 |
| 4,157,461 | A * | 6/1979 | Wiktor | H01H 9/26 200/18 |
| 7,462,791 | B1 | 12/2008 | Flegel | |
| 7,531,762 | B2 | 5/2009 | Flegel | |
| 7,602,083 | B1 | 10/2009 | Flegel et al. | |
| 7,834,282 | B2 | 11/2010 | Flegel | |
| 7,834,486 | B1 | 11/2010 | Flegel et al. | |
| 7,888,821 | B2 | 2/2011 | Flegel et al. | |
| 8,040,663 | B1 | 10/2011 | Czarnecki | |
| 8,110,759 | B2 | 2/2012 | Flegel | |
| 8,138,433 | B2 | 3/2012 | Czarnecki et al. | |
| 8,269,120 | B1 | 9/2012 | Flegel et al. | |

* cited by examiner

*Primary Examiner* — Renee Luebke
*Assistant Examiner* — Lheiren Mae A Caroc
(74) *Attorney, Agent, or Firm* — Boyle Fredrickson, S.C.

(57) ABSTRACT

A transfer switch configured to transfer connection of each power conductor and neutral conductor of a load between two power supplies. The transfer switch includes a switch member configured to transfer each of the connections in tandem. The transfer switch disconnects each power conductor prior to disconnecting the neutral conductor of the first supply when disconnecting the load from either power supply and connects the neutral connector prior to connecting each power conductor when connecting the load to either power supply.

14 Claims, 4 Drawing Sheets

TRANSFER SWITCH FOR SEQUENTIALLY DERIVED SYSTEM

BACKGROUND OF THE INVENTION

The invention relates generally to an electrical power transfer arrangement and, more particularly, to a switching arrangement for use with a separately-derived system.

A common electrical power supply system, such as that used in supplying electrical power to a building, includes two hot wires and a neutral wire and delivers dual voltage potentials to the building. For example, a typical dual voltage distribution system has a 240V voltage potential between the two hot wires and a 120V voltage potential between each hot wire and the neutral wire. An electrical distribution panel for use in such a system includes a pair of bus bars, each of which is connected to one of the hot leads, and on which circuit breakers are mounted to distribute the voltage to individual loads. A separate bus is typically provided along one or more sides of the distribution panel for neutral connections. A 240V load is connected across both bus bars while a 120V load is connected to a single bus bar and the neutral bus. Thus, a first portion of the electrical load is supplied via one of the hot wires and a second portion of the electrical load is supplied via the other of the hot wires with the neutral serving as the return wire between both portions of the electrical load.

In today's electrical supply systems, there are occasions when alternate sources of electrical power are necessary or desirable. For example, the capability of switching from a utility supply to a backup generator is extremely important for many businesses, hospitals and industries, as well as residential dwellings. The generator is configured to provide the same voltages as the utility connection, and switching between the power sources is typically performed at a transfer panel. Historically, the pair of hot wires from both the utility supply and the generator were provided as inputs to a first switch. The pair of hot wires output from the switch is connected to the pair of bus bars running beneath the circuit breakers. Whether the neutral wire is switched is dependent on the application requirements. In a non-separately derived system, the neutral wires of both the utility supply and the generator are directly connected to the neutral bar in the distribution panel. In a separately derived system, the neutral wires of the utility supply and the generator are supplied as the inputs to a second switch. The output of the second switch is connected to the neutral bar.

However, switching the neutral wire between the two power supplies in separately derived systems creates the potential for an open neutral event to occur. During an open neutral event, the two hot wires are connected without the neutral wire being connected. This may occur for a brief period during a switching event between power sources in a separately derived system if the switch transferring the hot leads establishes connection prior to the switch transferring the neutral leads. Because both portions of the electrical load share the neutral lead as the return, the resulting effect of the open neutral event is that the two 120V distribution paths are temporarily connected in series rather than in parallel. The 240V voltage potential between the two hot leads is temporarily applied across the two distribution paths in the system until the neutral lead connection is established. Although the period of time during which the 240V voltage potential is present across the devices is brief, it may be sufficient to damage certain devices connected to the distribution system.

Historically, it has been known, therefore, to provide either a single switch or to provide a mechanical interlock between the two switches such that each of the hot leads and the neutral lead for the utility supply and the generator are transferred at the same time. However, such solutions are not without drawbacks. Even though the switch or interlock is intended to simultaneously connect or disconnect each of the hot leads and the neutral lead, manufacturing tolerances and other variations between each throw of a switch creates the potential for delays between connecting or disconnecting the individual throws. The delays may be, for example, up to 10 msec in duration. Because the period of a standard 60 Hertz electrical waveform is 17 msec, such a delay is greater than half of the electrical cycle. If the neutral connection is either opened first or connected last, the delay results in an open neutral event of sufficient length that that either the maximum positive or negative voltage potential occurs at least once before the neutral connection is established.

Thus, it would be desirable to provide an improved switch transfer switch that eliminates the potential for the occurrence of an open neutral event.

SUMMARY OF THE INVENTION

The subject matter disclosed herein relates to a transfer switch configured to transfer connection of each power conductor and neutral conductor of a load between two power supplies. The transfer switch includes a switch member configured to transfer each of the connections in tandem. The transfer switch disconnects each power conductor prior to disconnecting the neutral conductor of the first supply when disconnecting the load from either power supply and connects the neutral connector prior to connecting each power conductor when connecting the load to either power supply.

According to one embodiment of the invention, an electrical switching device for selectively connecting at least one hot lead and a neutral lead from either a first power source or a second power source to an electrical load includes a first, second, and third set of contacts. The first set of contacts is configured to be electrically connected to the first power source, the second set of contacts is configured to be electrically connected to the second power source, and the third set of contacts is configured to be electrically connected to the electrical load. A plurality of blades, each having a first end and a second end, is pivotally connected to a contact from the third set of contacts at the first end. The second end engages a contact from the first set of contacts in a first position and engages a contact from the second set of contacts in a second position. A handle is connected to the second end of each blade to move each of the blades in tandem between the first position and the second position. The blade selectively connecting the neutral lead disengages from either the first or second set of contacts after the blades selectively connecting the hot leads, and engages with either the first or second set of contacts prior to the blades selectively connecting the hot leads.

According to one aspect of the invention, each of the blades has a first width proximate to the first end and a second width proximate to the second end. The second width of the blade configured to connect the neutral lead may be greater than the second width of each of the blades configured to connect the hot leads. Optionally, for a power source having two hot leads, the second width of a first blade configured to connect to a first hot lead may be less than the second width of a second blade configured to connect to a second hot lead, and the second width of the second blade may be less than the second width of the blade configured to connect to the neutral lead.

According to another aspect of the invention, each contact of the first and second sets of contacts has a height. The height of the contact configured to connect to the neutral lead is greater than the height of the contacts configured to connect to each of the hot leads. Optionally, for a power source having two hot leads, the height of a first contact configured to connect to a first hot lead may be less that the height of a second contact configured to connect to a second hot lead, and the height of the second contact may be less than the height of the contact configured to connect to the neutral lead.

According to still another aspect of the invention, the contact in the first and the second set of contacts configured to connect to the neutral lead is a first distance from the corresponding contact in the third set of contacts configured to connect to the neutral lead, each of the contacts in the first and the second set of contacts configured to connect to the hot leads are a second distance from the corresponding contacts in the third set of contacts configured to connect to the hot leads, and the second distance is greater than the first distance. Optionally, for a power source having two hot leads, a first contact in the first and the second set of contacts is configured to connect to a first hot lead, and a second contact in the first and the second set of contacts is configured to connect to a second hot lead. One of the first or second contacts is at the second distance from the corresponding contact in the third set of contacts, and the other of the first or second contacts is at a distance greater than the second distance from the corresponding contact in the third set of contacts.

According to yet another aspect of the invention, the electrical switching device may include a control signal, and an actuator. The actuator moves the handle between the first position and the second position as a function of the control signal for automatic transferring of the load between the two power sources.

According to another embodiment of the invention, a triple pole, double throw switching device includes a first, second, and third set of contacts. The first set of contacts is configured to be electrically connected to a first power source, and the second set of contacts is configured to be electrically connected to a second power source. The third set of contacts is selectively connected to either the first set or second set of contacts. A switch member is configured to establish an electrical connection between the first set of contacts and the third set of contacts in a first position and configured to establish an electrical connection between the second set of contacts and the third set of contacts in a second position. The switch member establishes the electrical connection between a first contact in the third set of contacts and a corresponding first contact in either the first or second set of contacts prior to establishing the electrical connection between the remaining contacts in the third set of contacts and the corresponding contacts in either the first or second set of contacts. The switch member breaks the electrical connection between the first contact in the third set of contacts and the corresponding first contact in either the first or second set of contacts after breaking the electrical connection between the remaining contacts in the third set of contacts and the corresponding contacts in either the first or second set of contacts.

According to other aspects of the invention, the switch member includes a plurality of blades. Each blade is pivotally connected to one of the contacts in the third set of contacts at a first end and configured to engage one of the contacts in either the first or second set of contacts at the second end. Each of the blades has a first width proximate to the first end and a second width proximate to the second end, and the blade configured to establish the electrical connection between the first contact in the third set of contacts and the corresponding first contact in either the first or second set of contacts may have a second width greater than the second width of the other blades. Each contact of the first and second sets of contacts has a height, and the height of the first contact in each of the first and second sets of contacts may be greater than the height of the other contacts in each of the first and second sets of contacts. The first contact in the first and the second sets of contact may be a first distance from the first contact in the third set of contacts, and each of the other contacts in the first and the second set of contacts may be a second distance from the corresponding contact in the third set of contacts, where the second distance is greater than the first distance.

According to another embodiment of the invention, a method of transferring connection of an electrical load from a first power supply to a second power supply is disclosed. Each power supply and the load have a pair of power conductors and a neutral conductor. Motion of a switch member from a first position to a second position is initiated. The continuing motion of the switch member disconnects each of the power conductors for the load from the first power supply while maintaining an electrical connection between the neutral conductor of the load and the neutral conductor of the first power supply. The continuing motion of the switch member next disconnects the neutral conductor of the load from the neutral conductor of the first power supply. The continuing motion of the switch member then connects the neutral conductor of the load to the neutral conductor of the second power supply while keeping the power conductors from the load disconnected from either power supply, and finally connects the power conductors for the load to the second power supply.

Other aspects, features, and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

The drawings illustrate the best mode presently contemplated of carrying out the invention.

In the drawings.

DETAILED DESCRIPTION

Referring now to the figures, the invention relates to an electrical switching device for transferring an electrical load between one of two power sources. The illustrated switch is intended for use in a system in which each power supply provides a three-wire connection, including a pair of conductors supplying power, or hot leads, and a neutral conductor. Further, the illustrated switch may utilize an operator to manually transfer the load between power supplies. Nevertheless, it is contemplated that other configurations of the switch could be implemented without deviating from the scope of the invention, including, but not limited to, a varying number of electrical conductors or an actuator and controller used to automatically transfer the load between power supplies.

Figure 1:
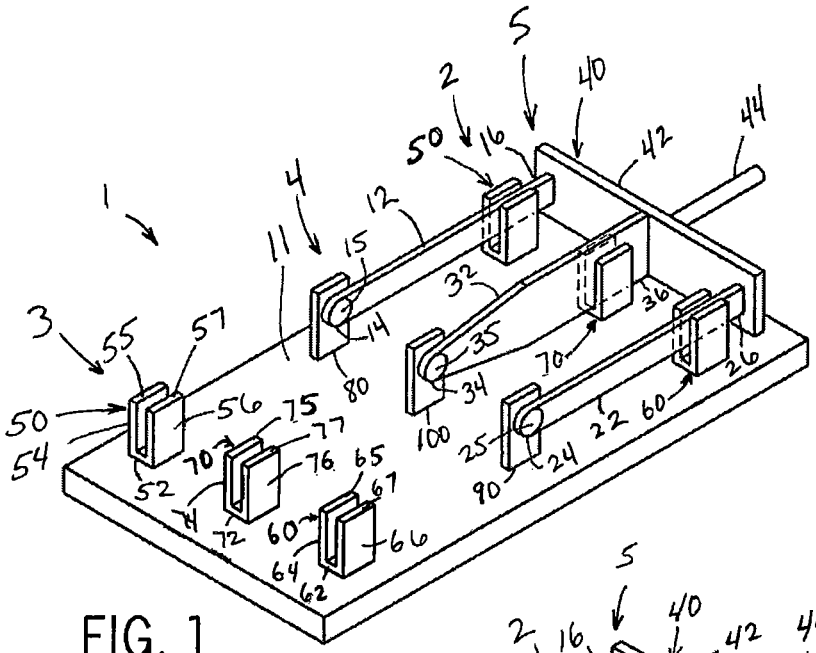
FIG. 1 is an isometric view of a knife switch according to a first embodiment of the invention.

According to one embodiment of the invention, illustrated in FIG. 1, a switch 1 includes a first set of contacts 2 and a second set of contacts 3 selectively connected to a third set of contacts 4. A switch member 5 connects the first set of contacts 2 to the third set of contacts 4 in a first position and connects the second set of contacts 3 to the third set of contacts 4 in a second position. The first set of contacts 2 is configured to be electrically connected to a first power source, the second set of contacts 3 is configured to be electrically connected to a second power source, and the third set of contacts 4 are configured to be electrically connected to a load. For example, the first power source may be the utility grid, the second power source may be a backup generator, and the load may be a building power supply system. The switch 1 includes a base 11 to which each set of contacts 2, 3, 4 is mounted and further includes a suitable electrical termination between each electrical conductor either from one of the power supplies or to the electrical load and the respective contact.

Each of the first set of contacts 2 and the second set of contacts 3 includes three clip-style contacts 50, 60, 70, also referred to as slotted contacts. In each of the first and second set of contacts 2, 3, a first contact 50 and a second contact 60 are connected to the pair of conductors supplying power from each power source. A third contact 70 is connected to the neutral conductor from each power source. Each of the clip style contacts 50, 60, 70 is generally u-shaped, having a base 52, 62, 72, respectively, mounted to the base 11 of the switch 1 and a first side 54, 64, 74, respectively, and a second side 56, 66, 76, respectively, extending away from the base 52, 62, 72, respectively.

The third set of contacts 4 is configured as an axis about which the switch member 5 pivots. In the third set of contacts 4, a first contact 80 and a second contact 90 are connected to the pair of conductors supplying power to the load. A third contact 100 is connected to the neutral conductor to the load. The switch member 5 includes a first blade 12, a second blade 22, and a third blade 32. A first end 14 of the first blade 12 is movably mounted to the first contact 80 at pivot 15. Similarly, a first end 24 of the second blade 22 is movably mounted to the second contact 90 at a pivot 25, and a first end 34 of the third blade 32 is movably mounted to the third contact 100 at a pivot 35. The second ends 16, 26, 36 of each blade 12, 22, 32, respectively, are connected to a handle 40. The handle 40 includes a tie bar 42 connected to each of the second ends 16, 26, 36 of each blade 12, 22, 32, respectively, and an actuating member 44 extending from the tie bar 42. In a first position, each blade 12, 22, 32 extends between one of the contacts 80, 90, 100, respectively, of the third set of contacts 4 and the respective contact 50, 60, 70 of the first set of contacts 2. In a second position, each blade 12, 22, 32 extends between one of the contacts 80, 90, 100, respectively, of the third set of contacts 4 and the respective contact 50, 60, 70 of the second set of contacts 3.

According to the illustrated embodiment, each blade 12, 22, 32 has a first width, W1, at its first end 14, 24, 34, respectively, and a second width, W2, at its second end 16, 26, 36, respectively. The first blade 12 and the second blade 22 have a first width, W1, and a second width, W2, that are substantially equal. The third blade 32 is tapered such that it has a first width, W1, that is less than the second width, W2. Optionally, each blade 12, 22, 32 may have varying relationships between the first width, W1, and the second width, W2, for each end of the blades 12, 22, 32. For example, the first and second blades 12, 22 may also be tapered or the third blade 32 may have a uniform width. Regardless of the relationship between the first width, W1, and the second width, W2, for individual blades 12, 22, 32, the second width, W2, of the third blade 32 is greater than the second width, W2, of each of the first and second blades 12, 22.

Figure 2:
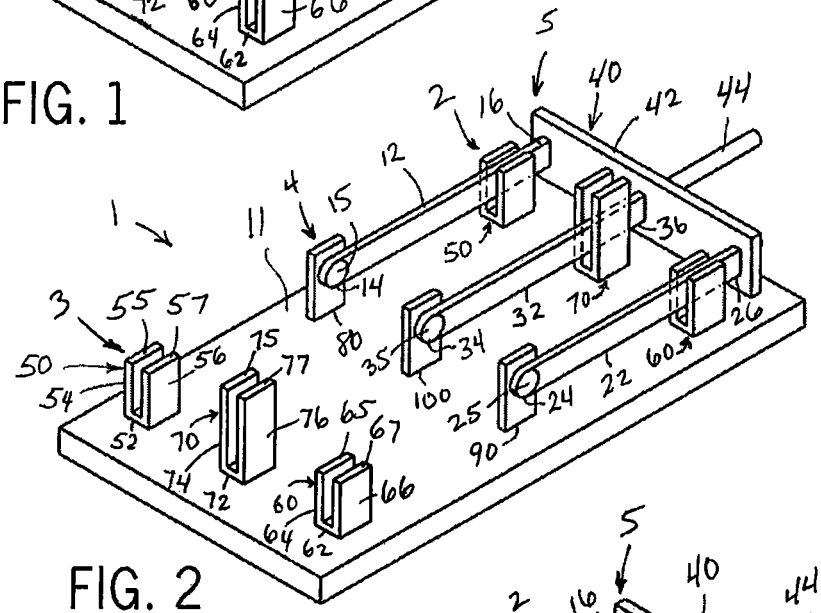
FIG. 2 is an isometric view of a knife switch according to a second embodiment of the invention.

According to another embodiment of the invention, illustrated in FIG. 2, the switch 1 is constructed in a similar manner to the switch of FIG. 1. The switch 1 includes a first set of contacts 2 and a second set of contacts 3 selectively connected to a third set of contacts 4. A switch member 5 connects the first set of contacts 2 to the third set of contacts 4 in a first position and connects the second set of contacts 3 to the third set of contacts 4 in a second position. The switch 1 includes a base 11 to which each set of contacts 2, 3, 4 is mounted and further includes a suitable electrical termination between each electrical conductor either from one of the supplies or to the electrical load and the respective contact. Each of the first set of contacts 2 and the second set of contacts 3 includes three clip-style contacts 50, 60, 70. The third set of contacts 4 is configured as an axis about which the switch member 5 pivots and includes three contacts 80, 90, 100 having a pivot member 25, 35, 45, respectively, to which blades 12, 22, and 32, respectively, are movably connected.

In this embodiment, the first width, W1, and the second width, W2, of each blade 12, 22, 32 is substantially uniform; however, the heights of each contact 50, 60, 70 in the first and second sets 2, 3 may vary. Each of the clip-style contacts 50, 60, 70 has a height extending from the lower surface of the base 52, 62, 72 to the respective end of each side. For example, the first side 54 of the first clip 50 extends between the base 52 and a first end 55. The second side 56 of the first clip 50 extends between the base 52 and a second end 57. The height that each side 54, 56 extends between the base 52 and its respective end 55, 57 is the same. As illustrated, the first contact 50 and the second contact 60 each have a first height, H1, and the third contact 70 has a second height, H2, where the second height, H2, is greater than the first height, H1. Optionally, each contact 50, 60, 70 may have different heights, where the height of the third contact 70 is greater than the height of the first and second contacts 50, 60.

Figure 3:
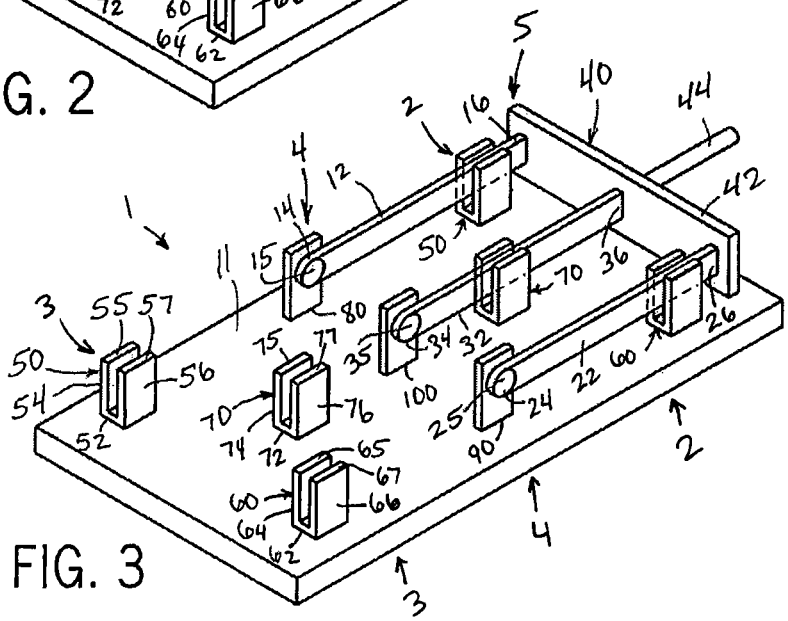
FIG. 3 is an isometric view of a knife switch according to a third embodiment of the invention.
Figure 1A:
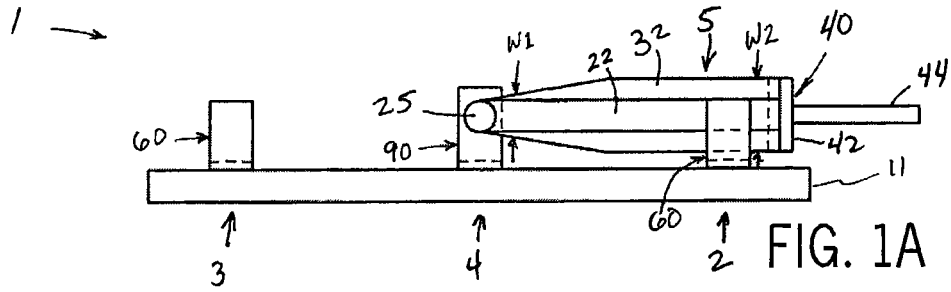
FIG. 1A is a side elevation view of the knife switch of FIG. 1 illustrating the blades engaged with a first set of contacts.
Figure 1B:
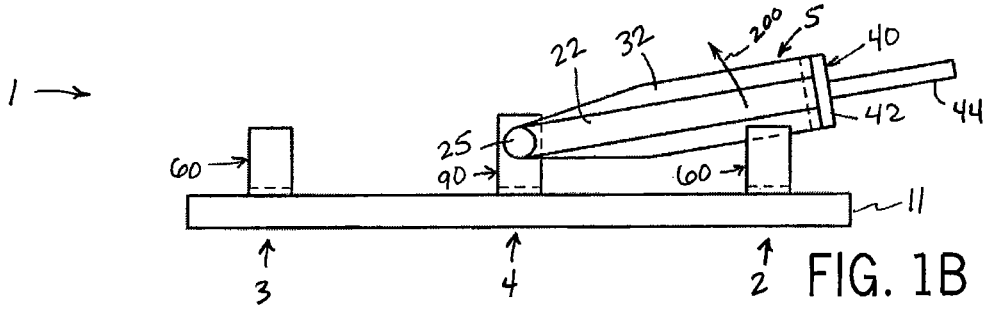
FIG. 1B is a side elevation view of the knife switch of FIG. 1 illustrating a staggered disengagement of the blades from the first set of contacts.
Figure 1C:
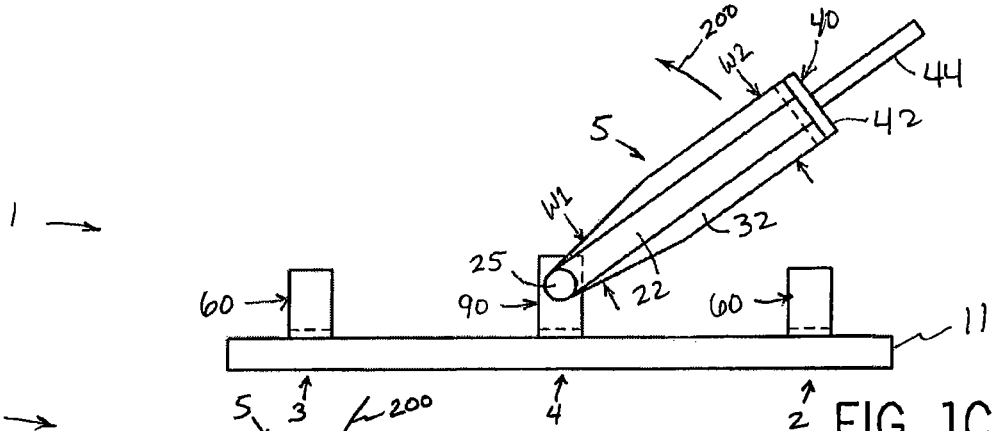
FIG. 1C is a side elevation view of the knife switch of FIG. 1 illustrating the blades disengaged from either set of contacts and rotating toward a second set of contacts.
Figure 1D:
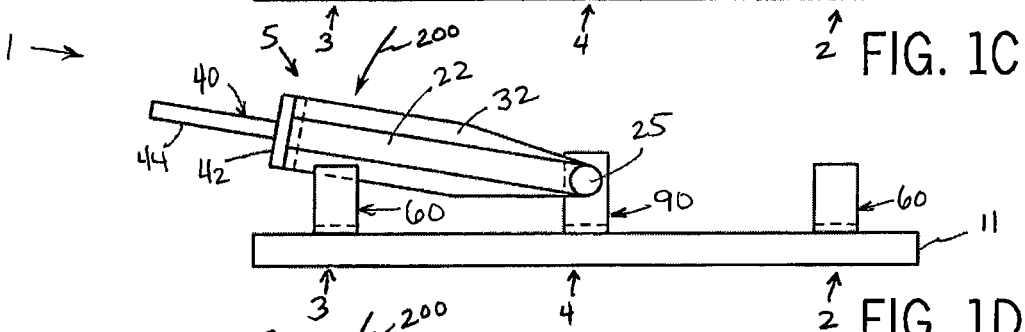
FIG. 1D is a side elevation view of the knife switch of FIG. 1 illustrating a staggered engagement of the blades with the second set of contacts.
Figure 1E:
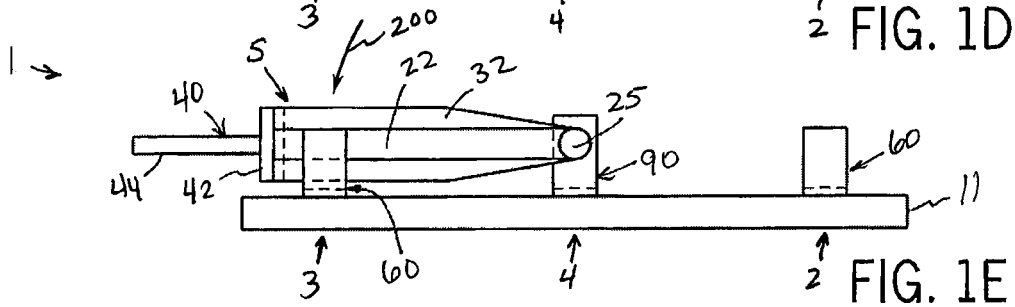
FIG. 1E is a side elevation view of the knife switch of FIG. 1 illustrating the blades engaged with the second set of contacts.
Figure 2A:
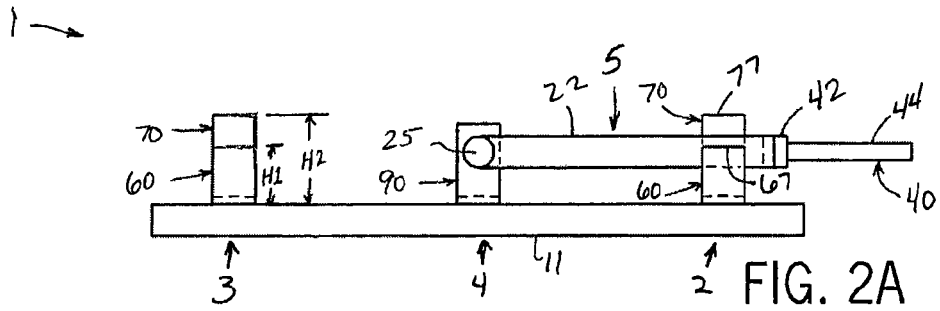
FIG. 2A is a side elevation view of the knife switch of FIG. 2 illustrating the blades engaged with a first set of contacts.
Figure 2B:
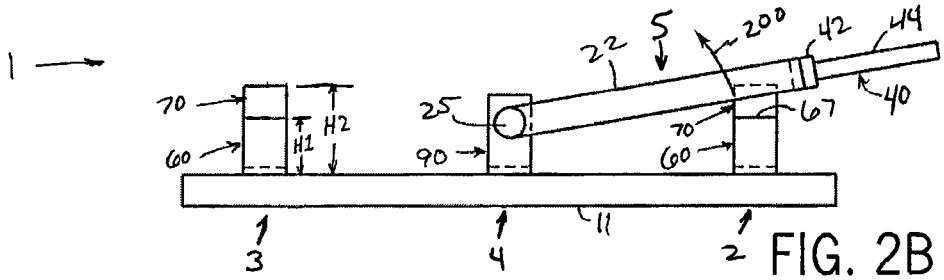
FIG. 2B is a side elevation view of the knife switch of FIG. 2 illustrating a staggered disengagement of the blades from the first set of contacts.
Figure 2C:
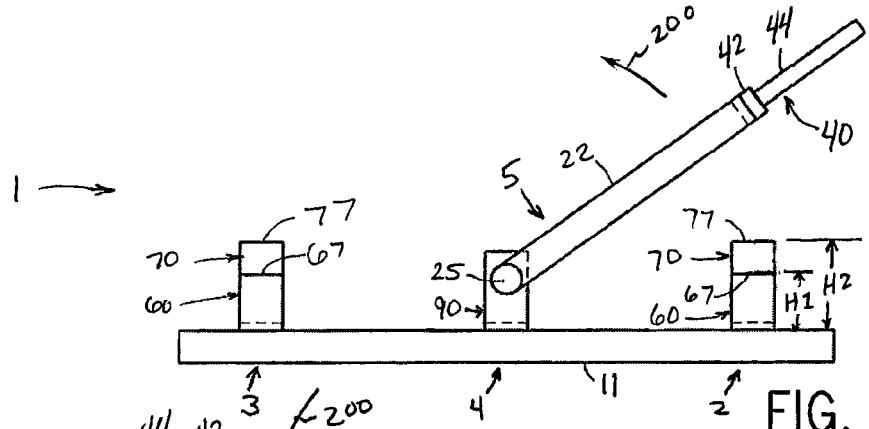
FIG. 2C is a side elevation view of the knife switch of FIG. 2 illustrating the blades disengaged from either set of contacts and rotating toward a second set of contacts.
Figure 2D:
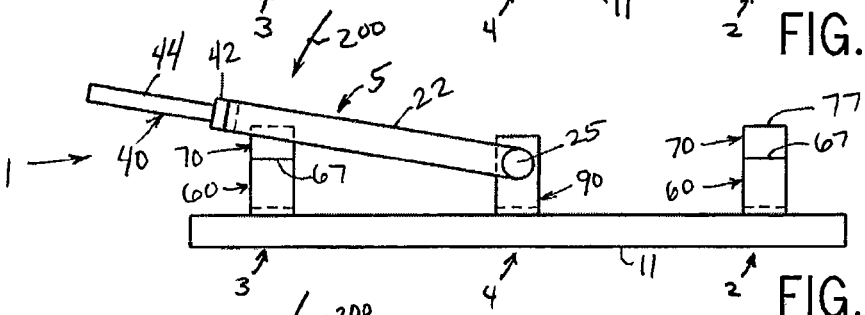
FIG. 2D is a side elevation view of the knife switch of FIG. 2 illustrating a staggered engagement of the blades with the second set of contacts.
Figure 2E:
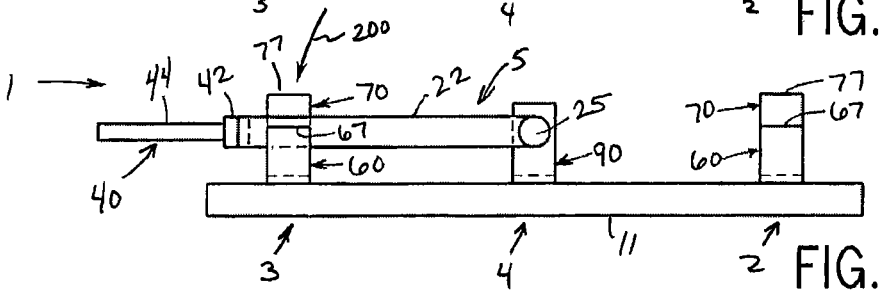
FIG. 2E is a side elevation view of the knife switch of FIG. 2 illustrating the blades engaged with the second set of contacts.
Figure 3A:
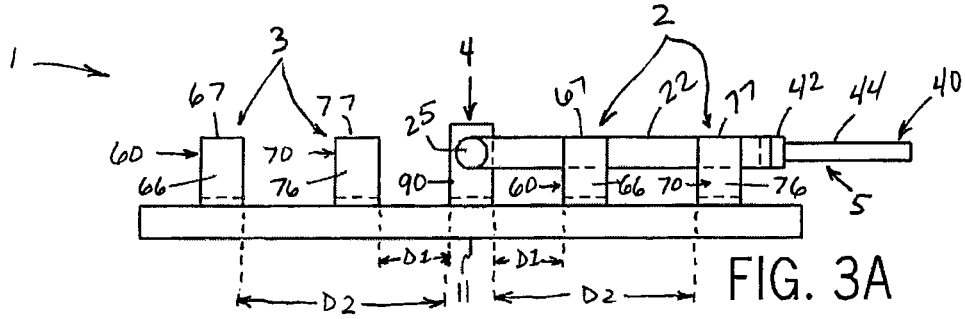
FIG. 3A is a side elevation view of the knife switch of FIG. 3 illustrating the blades engaged with a first set of contacts.
Figure 3B:
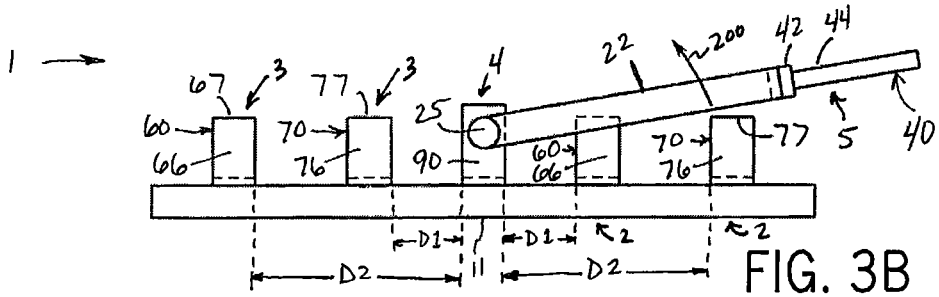
FIG. 3B is a side elevation view of the knife switch of FIG. 3 illustrating a staggered disengagement of the blades from the first set of contacts.
Figure 3C:
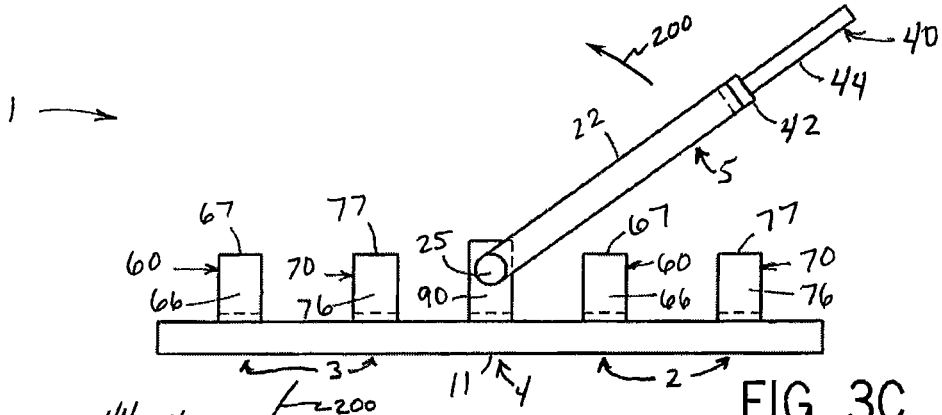
FIG. 3C is a side elevation view of the knife switch of FIG. 3 illustrating the blades disengaged from either set of contacts and rotating toward a second set of contacts.
Figure 3D:
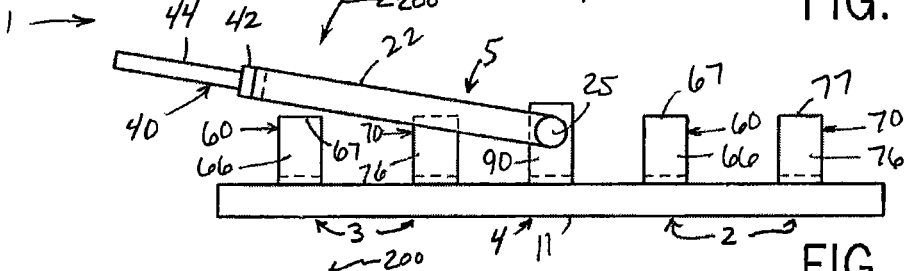
FIG. 3D is a side elevation view of the knife switch of FIG. 3 illustrating a staggered engagement of the blades with the second set of contacts.
Figure 3E:
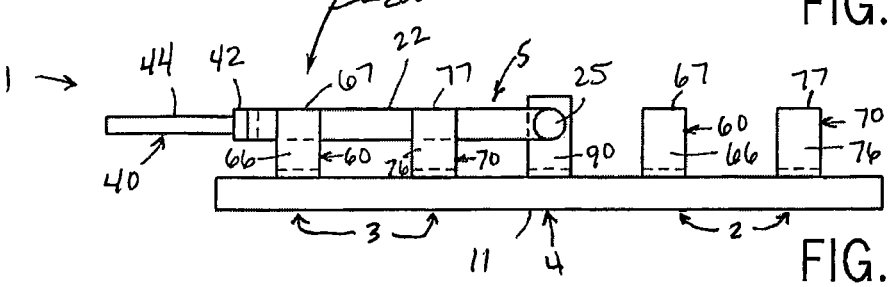
FIG. 3E is a side elevation view of the knife switch of FIG. 3 illustrating the blades engaged with the second set of contacts.

According to still another embodiment of the invention, illustrated in FIG. 3, the switch 1 is constructed in a similar manner to the switches of FIGS. 1 and 2. The switch 1 includes a first set of contacts 2 and a second set of contacts 3 selectively connected to a third set of contacts 4. A switch member 5 connects the first set of contacts 2 to the third set of contacts 4 in a first position and connects the second set of contacts 3 to the third set of contacts 4 in a second position. The switch 1 includes a base 11 to which each set of contacts 2, 3, 4 is mounted and further includes a suitable electrical termination between each electrical conductor either from one of the supplies or to the electrical load and the respective contact. Each of the first set of contacts 2 and the second set of contacts 3 includes three clip-style contacts 50, 60, 70. The third set of contacts 4 is configured as an axis about which the switch member 5 pivots and includes three contacts 80, 90, 100 having a pivot member 25, 35, 45, respectively, to which blades 12, 22, and 32, respectively, are movably connected.

In this embodiment, the first width, W1, and the second width, W2 of each blade 12, 22, 32 is substantially uniform, and the height of each contact 50, 60, 70 is substantially uniform; however, the distance between each contact 50, 60, 70 of the first and second sets 2, 3 and each contact 80, 90, 100 of the third set 4 may vary. As illustrated, the third contact 70 of the first and second sets of contacts 2, 3 is positioned a first distance, D1, from the third contact 100 of third set of contacts 4. Each of the first and second contacts 50, 60 of the first and second sets of contacts 2, 3 is positioned a second distance, D2, from the first and second contacts 80, 90 of third set of contacts 4, where the first distance, D1, is less than the second distance, D2. Optionally, each of the first contacts 50, second contacts 60, and third contacts 70 in the first and second sets of contacts 2, 3, may be a different distance from the respective first contact 80, second contact 90, or third contact 100 in the third set of contacts 4, where the distance between the third contacts, 70 and 100, is less than the distance between either the first contacts, 50 and 80, or the second contacts, 60 and 90.

In operation, the switch member 5 is moved between the first position and the second position to selectively establish an electrical connection between one of the poles (i.e. the first set or second set of contacts 2, 3) and the common connection (i.e. the third set of contacts 4). Either the switch member 5 or the contacts are configured such that the neutral connection between either power source and the load is disconnected after the power connections as the switch member 5 disconnects one of the power sources and the neutral connection between either power source and the load is connected prior to either power connection as the switch member 5 connects one of the power sources to the load. An exemplary transition from the first position to the second position is illustrated in each set of FIGS. 1A-1E, 2A-2E, 3A-3E for the respective embodiment discussed in FIG. 1, 2, or 3. As referred to below, FIGS. A-E are representative of each embodiment illustrated in FIGS. 1A-1E, 2A-2E, 3A-3E.

Referring then to FIGS. A-E, the transition of the switch member 5 between the first position and the second position is illustrated. The power conductors from each of the first and second power source are connected to the first and second contacts 50, 60 of the respective first and second set of contacts 2, 3. The neutral conductor from each of the first and second power source is connected to the third contact 70 of the respective first and second set of contacts 2, 3. Similarly, each of the power conductors to the load are connected to the first and second contacts 80, 90 of the third set of contacts 4, and the neutral conductor to the load is connected to the third contact 100 of the third set of contacts 4.

In FIG. A, the switch member 5 is shown in the first position. Each of the blades 12, 22, 32 is fully inserted into the respective clip-style contact 50, 60, 70 of the first set of contacts 2, establishing an electrical connection between each of the power leads and the neutral lead from the first power source to the load. Transitioning to FIG. B, the switch member 5 is rotated about pivots 15, 25, 35 in an arc 200. The first and second blades 12, 22 disengage from the first and second contacts 50, 60 of the first set of contacts 2 while the third blade 32 remains engaged with the third contact 70. Moving next to FIG. C, the switch member is rotated further about pivots 15, 25, 35 along arc 200 such that the third blade 32 disengages from the third contact 70 of the first set of contacts 2. As the switch member 5 continues to move along arc 200, the third blade 32 engages the third contact 70 of the second set of contacts 3 while the first and second blades 12, 22 remain disengaged from any contacts, as illustrated in FIG. D. Finally, in FIG. E, each of the blades 12, 22, 32 is fully inserted into the respective clip-style contact 50, 60, 70 of the second set of contacts 3, establishing an electrical connection between each of the power leads and the neutral lead from the second power source to the load. According to one embodiment of the invention, the space between each of sides of the clip-style contacts 50, 60, 70 in an unbiased state is less than the thickness of the respective blade 12, 22, 32. Insertion of the blade 12, 22, 32 into the contact 50, 60, 70 causes each of the sides to deflect outward, exerting a spring force against the blade 12, 22, 32 to ensure the sides engage the blade 12, 22, 32 and establish a solid electrical connection therebetween.

As an option to the arrangement illustrated in FIG. 3, the third contacts 70 may be positioned at generally the same distance from third contact 100 as first and second contacts 50, 60 are spaced from the first and second contacts 80, 90, but the third contacts 70 have a width greater than the second contacts. With this arrangement, the inner edges of the third contacts 70 are closer to the common central pivot axis than the inner edges of the first and second contacts 50, 60, so that the connection with third contacts 70 makes first and breaks last during movement of the blades 12, 22, 32.

It is contemplated that one or more combinations of the mechanical arrangements described in each of the embodiments above may be incorporated into the switching device such that the throw configured to connect neutral conductors is the last to be disconnected and the first to be connected during a switching event. It is further contemplated that the switching device may be mounted within a housing and include a control signal corresponding, for example, to the operating condition of the utility power. The control signal may be used to activate a bidirectional actuator or a pair of unidirectional actuators to move the switch member between the first and the second position as a function of the control signal. For example, upon a loss of the utility grid, the switch member may disconnect a load from the utility grid and connect the load to a backup generator.

Various alternatives and embodiments are contemplated as being within the scope of the following claims particularly pointing out and distinctly claiming the subject matter regarded as the invention.

The invention claimed is:

1. A triple pole, double throw switching device, comprising:

a first set of contacts including at least a first hot contact and a first neutral contact, wherein the first hot contact and the first neutral contact are interconnected with first power source;

a second set of contacts including at least a second hot contact and a second neutral contact, wherein the second hot contact and the second neutral contact are interconnected with a second power source, and wherein an open area is located between the first and second sets of contacts;

a third set of contacts for selective connection to either the first set or second set of contacts, the third set of contacts including at least one third hot contact and a third neutral contact, wherein the third hot contact and the third neutral contact are interconnected with an electrical load;

a pivotable switch member electrically connected to the third set of contacts, wherein the switch member is configured to establish an electrical connection between the first set of contacts and the third set of contacts in a first position and configured to establish an electrical connection between the second set of contacts and the third set of contacts in a second position, wherein the switch member is movable through the open area between the first and second contacts during movement of the switch member between the first and second positions, and wherein the switch member is further configured to be disengaged from both the first set of contacts and the second set of contacts when in an intermediate position between the first position and the second position and located within the open area between the first and second sets of contacts, wherein the switch member establishes the electrical connection between the third neutral contact and the first neutral contact prior to establishing the electrical connection between each of the third hot contacts and the corresponding first hot contact during movement of the switch member from the open area toward the first position, and establishes the electrical connection between the third neutral contact and the second neutral contact prior to establishing the electrical connection between each of the third hot contacts and the corresponding second hot contact during movement of the switch member from the open area toward the second position, and wherein the switch member breaks the electrical connection between the third neutral contact and the first neutral contact after breaking the electrical connection between each of the third hot contacts and the corresponding first hot contact during movement from the first position toward the open area, and breaks the electrical connection between the third neutral contact and the second neutral contact after breaking the electrical connection between each of the third hot contacts and the corresponding second hot contact during movement from the second position toward the open area.

2. The triple pole, double throw switching device of claim 1, wherein the switch member includes a handle for use by an operator for moving the switch member between the first position and the second position.

3. The triple pole, double throw switching device of claim 1, wherein:

the switch member includes a plurality of blades, each blade pivotally connected to one of the contacts in the third set of contacts at a first end and configured to engage one of the contacts in either the first or second set of contacts at a second end, each of the blades has a first width proximate to the first end and a second width proximate to the second end, and the blade configured to establish the electrical connection between the third neutral contact and the first and second neutral contacts has a second width greater than the second width of the other blades.

4. The triple pole, double throw switching device of claim 1, wherein:

each contact of the first and second sets of contacts has a height, and the height of the first and second neutral contacts is greater than the height of the first and second hot contacts, respectively.

5. The triple pole, double throw switching device of claim 1, wherein:

the first and the second neutral contacts are a first distance from the third neutral contact, each of the first and the second hot contacts is a second distance from the corresponding third hot contact, and the second distance is greater than the first distance.

6. A method of transferring connection of an electrical load from a first power supply to a second power supply, wherein a first set of contacts including at leas one first hot contact and a first neutral contact are interconnected with the first power supply and a second set of contacts including at least one second hot contact and a second neutral contact are interconnected with the second power supply, comprising the steps of:

initiating pivoting motion of a switch member, which is electrically connected to the electrical load via at least one third hot contact and a third neutral contact, from a first position to a second position, wherein an open area is located between the first and second sets of contacts and wherein the switch member pivotably moves through the open area during movement between the first and second positions;

disconnecting the at least one third hot contact from the at least one first hot contact as a result of the motion of the switch member away from the first position toward the open area between the first and second sets of contacts while maintaining an electrical connection between the third neutral contact and the first neutral contact;

subsequently disconnecting the third neutral contact from the first neutral contact as a result of the continuing motion of the switch member away from the first position and into the open area between the first and second sets of contacts;

advancing the switch member through the open area between the first and second sets of contacts away from the first position toward the second position, wherein when the switch member is located within the open area the switch member is in an intermediate position in which the switch member is disengaged from both the first and second sets of contacts;

subsequently advancing the switch member from the open area toward the second position and connecting the third neutral contact to the second neutral contact as a result of the continuing motion of the switch member toward the second position prior to connecting the at least one third hot contact with the at least one second hot contact; and subsequently connecting the at least one third hot contact to the at least one second hot contact as a result of the continuing motion of the switch member to the second position.

7. An electrical switching device for selectively connecting either a first power source or a second power source to an electrical load, comprising:

a first set of contacts including at least one first hot contact and a first neutral contact, wherein the first set of contacts are interconnected with the first power source;

a second set of contacts including at least one second hot contact and a second neutral contact, wherein the second set of contacts are interconnected with the second power source;

a third set of contacts including at least one third hot contact and a third neutral contact, wherein the third set of contacts are interconnected with the electrical load; and a pivotable switch member including at least a hot blade and a neutral blade, wherein the hot and neutral blades are each electrically connected to a contact from the third set of contacts, and wherein the switch member is pivotably movable to a first position in which the hot and neutral blades electrically connect the third set of contacts with the first set of contacts and to a second position in which the hot and neutral blades electrically connect the third set of contacts with the second set of contacts, wherein pivoting movement of the switch member between the first and second positions causes movement of the hot and neutral blades in unison;

wherein an open area is located between the first and second sets of contacts and wherein the switch member including the hot and neutral blades moves through the open area during movement of the switch member between the first and second positions; and wherein the switch member, the first set of contacts, and the second set of contacts are configured and arranged such that, during movement of the switch member away from the first position toward the open area between the first and second sets of contacts, the neutral blade disengages from the first neutral contact after the hot blade is disengaged from the at least one first hot contact, and when the switch member approaches the second position from the open area between the first and second sets of contacts, the neutral blade engages the second neutral contact before the hot blade engages the at least second hot contact; and wherein when the switch member is in the open area between the first and second sets of contacts, the switch member is in an intermediate position in which the hot and neutral blades are disengaged from both the first set of contacts and the second set of contacts so as to prevent the supply of power to the load from either the first power source or the second power source.

8. The electrical switching device of claim 7, wherein:

each of the blades defines a first end and a second end, wherein the first end of each blade is pivotably connected to a contact from the third set of contacts, and wherein each blade has a first width proximate to the first end and a second width proximate to the second end, and wherein the second width of the neutral blade is greater than the second width of the hot blade.

9. The electrical switching device of claim 8, wherein the second widths of each of the hot blades are substantially equal.

10. The electrical switching device of claim 7, wherein:

each contact of the first and second sets of contacts has a height, and the height of the first neutral contact is greater than the height of each of the first hot contacts and the height of the second neutral contact is greater than the height of each of the second hot contacts.

11. The electrical switching device of claim 10, wherein the height of each of the first hot contacts is substantially the same and the height of each of the second hot contacts is substantially the same.

12. The electrical switching device of claim 7, wherein:

the first and the second neutral contacts are located closer to the third set of contacts than the first and second hot contacts, respectively.

13. The electrical switching device of claim 12, wherein each of the first hot contacts is located at the same distance from the third set of contacts and each of the second hot contacts is located at the same distance from the third set of contacts.

14. The electrical switching device of claim 7, wherein the switch member includes a handle for use by an operator for moving the switch member between the first and second positions.

* * * * *